US006570046B2

(12) United States Patent
Linn et al.

(10) Patent No.: US 6,570,046 B2
(45) Date of Patent: May 27, 2003

(54) COMPOSITION FOR ACETYLENE PRODUCTION AND METHOD FOR TREATING LIME SLURRY BY-PRODUCT FROM ACETYLENE PRODUCTION

(75) Inventors: G. Wayne Linn, Ashtabula, OH (US); Nancy H. Davis, Ashtabula, OH (US); Michael D. Simons, Ashtabula, OH (US); Mark F. Nilsen, Ashtabula, OH (US)

(73) Assignee: Elkem Limited, Moon Township, PA (US)

( * ) Notice: Subject to any disclaimer, the term of this patent is extended or adjusted under 35 U.S.C. 154(b) by 0 days.

(21) Appl. No.: 09/931,690

(22) Filed: Aug. 16, 2001

(65) Prior Publication Data

US 2003/0040654 A1 Feb. 27, 2003

(51) Int. Cl.[7] ..... C07C 5/32; C07C 1/00

(52) U.S. Cl. ..... 585/534; 585/638

(58) Field of Search ..... 585/534, 638

(56) References Cited

FOREIGN PATENT DOCUMENTS

CN 1138556 A * 12/1996

OTHER PUBLICATIONS

The English abstract of CN–1138556–A.*

* cited by examiner

*Primary Examiner*—Thuan D. Dang
(74) *Attorney, Agent, or Firm*—Muserlian, Lucas and Mercanti

(57) ABSTRACT

The use of a settling aid in the reactor during acetylene production results in the by-product lime slurry being easier to handle and allows the acetylene producers to use different sources of calcium carbide as well as the calcium carbide manufacturers to use different sources of raw materials to make calcium carbide.

12 Claims, 1 Drawing Sheet

COMPOSITION FOR ACETYLENE PRODUCTION AND METHOD FOR TREATING LIME SLURRY BY-PRODUCT FROM ACETYLENE PRODUCTION

BACKGROUND OF THE INVENTION

1. Field of the Invention

This invention relates to a composition for use in the production of acetylene gas and a method for treating the lime slurry by-product from acetylene gas production to make the slurry easier to handle and avoid the need for special handling equipment for the sediment. The present invention allows an acetylene producer to use calcium carbide from a variety of sources and allows the calcium carbide producer more flexibility in sourcing raw materials.

2. Art Related to the Invention

Calcium carbide ($CaC_2$) is produced in an electric furnace by heating a mixture of lime and carbonaceous materials such as coke, coal, or charcoal. The heat of the furnace converts the mixture to calcium carbide and carbon monoxide. Both the source of lime and the source of carbonaceous material have different impurities which are carried through to the calcium carbide. Typically, industrial grade calcium carbide, sold for the generation of acetylene gas, contains about 2% to about 5% by weight impurities. The primary impurities are metals and metal alloys such as silicon, iron, aluminum and magnesium.

One of the conventional methods for producing acetylene ($CH{\equiv}CH$) is the action of water on calcium carbide. One of the by-products from such production is a lime slurry. This lime slurry essentially comprises calcium hydroxide, water, and whatever impurities were present in the calcium carbide.

The lime slurry is pumped from the reactor to settling tanks where water is removed for recycling and sediment forms. Water from the slurry is saturated with acetylene and is therefore preferred as a source of water in the reactor. By using recycled water, the overall efficiency of the reaction is increased. Thus, it is important that the slurry settle rapidly and form the sediment.

Once water has been removed from the slurry for recycling and the sediment formed in the holding tanks, water is added to the sediment to reslurry the sediment and make the sediment easier to pump.

It has been found that the lime slurry and the resulting sediment have different physical characteristics, especially settling characteristics and reslurrying characteristics, depending on the source of calcium carbide. These different characteristics have been attributed to the impurities which are present in the calcium carbide. For example, when the calcium carbide is produced from petroleum coke, the lime slurry settles slowly, the sediment is diffuse and readily reslurries. On the other hand, when metallurgical coke is used to make the calcium carbide, the lime slurry settles quickly, the sediment is dense and is difficult to reslurry.

Because of the differences in the settling properties of the lime slurry and the reslurrying characteristics of the sediment, different mechanical equipment is employed to handle the sediment. Thus, acetylene producers generally do not switch calcium carbide sources. Furthermore, calcium carbide producers are forced to standardize their sources of raw materials so as to maintain the same type of impurities in their calcium carbide. Needless to say, this means that the calcium carbide manufacturers are unable to switch their sources of raw material, thereby increasing the overall cost for production of calcium carbide which, in turn, increases the overall cost for production of acetylene.

There is a need for a simple and inexpensive way to treat the lime slurry by-product from the acetylene manufacturing process so as to increase the settling rate while improving the handling properties of the sediment which results from the lime slurry so as to reslurry readily and to be easy to handle, even after sitting a number of days in the holding tanks.

SUMMARY OF THE INVENTION

It has now been discovered that a settling aid, present in the reactor during production of acetylene, can effect the settling property of the by-product lime slurry and can effect the handling properties of the sediment. The use of the settling aid of the present invention has been found to increase in the rate of settling of the lime slurry, thus increasing the rate of recycling of water from the slurry. It has also been found to improve the reslurrying properties of the sediment thereby assisting in removal and handling of the sediment.

Specifically, it has been found that by employing the present invention, no special equipment is necessary for handling the lime slurry or the sediment that results from the lime slurry. Furthermore, it has been found that the acetylene manufacturer may vary the sources of calcium carbide without having to modify or change the lime slurry and sediment handling equipment. The present invention also allows the calcium carbide manufacturer to vary the sources of raw material. Both of these allow for lower production costs of calcium carbide and acetylene.

Furthermore, it has been found that by employing the present invention there is no detrimental effect to the reactor or the reaction that occurs in the acetylene reactor. The settling aid, although present in the reactor, does not affect the rate of reaction and has been found to carry through the reactor and into the lime slurry.

Furthermore, it has been found that the settling aid settles with the sediment and is not carried through into the recycled water. All this allows the acetylene manufacturer to continue his operations as normal with the improved benefit of allowing him to change the sources of calcium carbide.

Additionally, it is important that the sediment can be reslurried after a period of time. It has been found that the sediment of the present invention can sit for a number of days and still be reslurried and effectively pumped.

The settling aid of the present invention can be added directly to the acetylene reactor by the acetylene manufacturer or it can be added to either or both of the reactants, calcium carbide and water, prior to introduction into the acetylene reactor.

The settling aid may also be added directly to the lime slurry as it leaves the reactor, however, it is preferred that the settling aid be present in the reactor during the formation of the lime slurry.

It has also been discovered that the settling aid can be added to the top of the sediment in the holding tank prior to reslurrying the sediment and that such top treatment will beneficially effect the reslurrying properties of the sediment. Since such a treatment only effects the handling properties of the sediment and not the initial settling properties of the lime slurry and recycling of water to the reactor, it is not a preferred embodiment of the present invention.

The calcium carbide manufacturer can form a mixture of the calcium carbide and the settling aid and sell the mixture to the acetylene manufacturer. This allows the calcium carbide manufacturer to vary the source of raw material used to make calcium carbide without troubling the acetylene manufacturer.

Suitable settling aids for use in the present invention comprise phosphates, chelating agents, alkali metal chlorides, carbonates, carboxylic acids, sulfur compounds, clays, sugars, silica fume, and lignin.

Broadly, the present invention is a method for treating a lime slurry by-product from acetylene production to make the lime slurry and its resulting sediment easier to handle, said method comprising:

reacting water with calcium carbide in a reactor to form acetylene and a lime slurry by-product in the presence of a settling aid; and recovering said lime slurry by-product with said settling aid present therein.

The method of the present invention can also be broadly defined as an improvement in the method for making acetylene gas from calcium carbide and water where a lime slurry is a by-product, the improvement comprising:

reacting said water and said calcium carbide in a reactor in the presence of a settling aid to form acetylene gas and a lime slurry by-product; and recovering said lime slurry by-product with said settling aid present therein.

The method of the present invention can also be characterized as treating a lime slurry by-product from an acetylene manufacturing process or a sediment from the lime slurry by-product from the acetylene manufacturing process with a settling aid to improve the settling properties of the lime slurry and the handling properties of the sediment.

Thus, the present invention can be characterized as a new use of a settling aid where that new use is as an additive to an acetylene reaction and/or the by-product lime slurry and sediment.

The present invention has also led to discovery of a new composition for use in the production of acetylene, that composition being broadly defined as comprising a homogeneous mixture of calcium carbide and a settling aid.

As brought out above, it has been found that the settling aid which is present in the reactor ends up in the lime slurry, is carried into the settling tanks and ultimately stays with the sediment in the settling tanks. Thus, it is not carried away with the recycling water. Furthermore, it has been found that a number of the settling aids are environmentally friendly and, thus, the sediment with the settling aid therein is readily disposable without the need for further handling or treatment of the sediment.

Furthermore, it has been found that the present invention has no detrimental effect on the recycle water and, in fact, has the beneficial effect of increasing the rate of settling thereby increasing the rate of availability of the recycle water.

These and other aspects of the present invention may be more fully understood by reference to the following drawings and detailed description of the invention that follows.

DETAILED DESCRIPTION OF THE INVENTION

Figure 1:
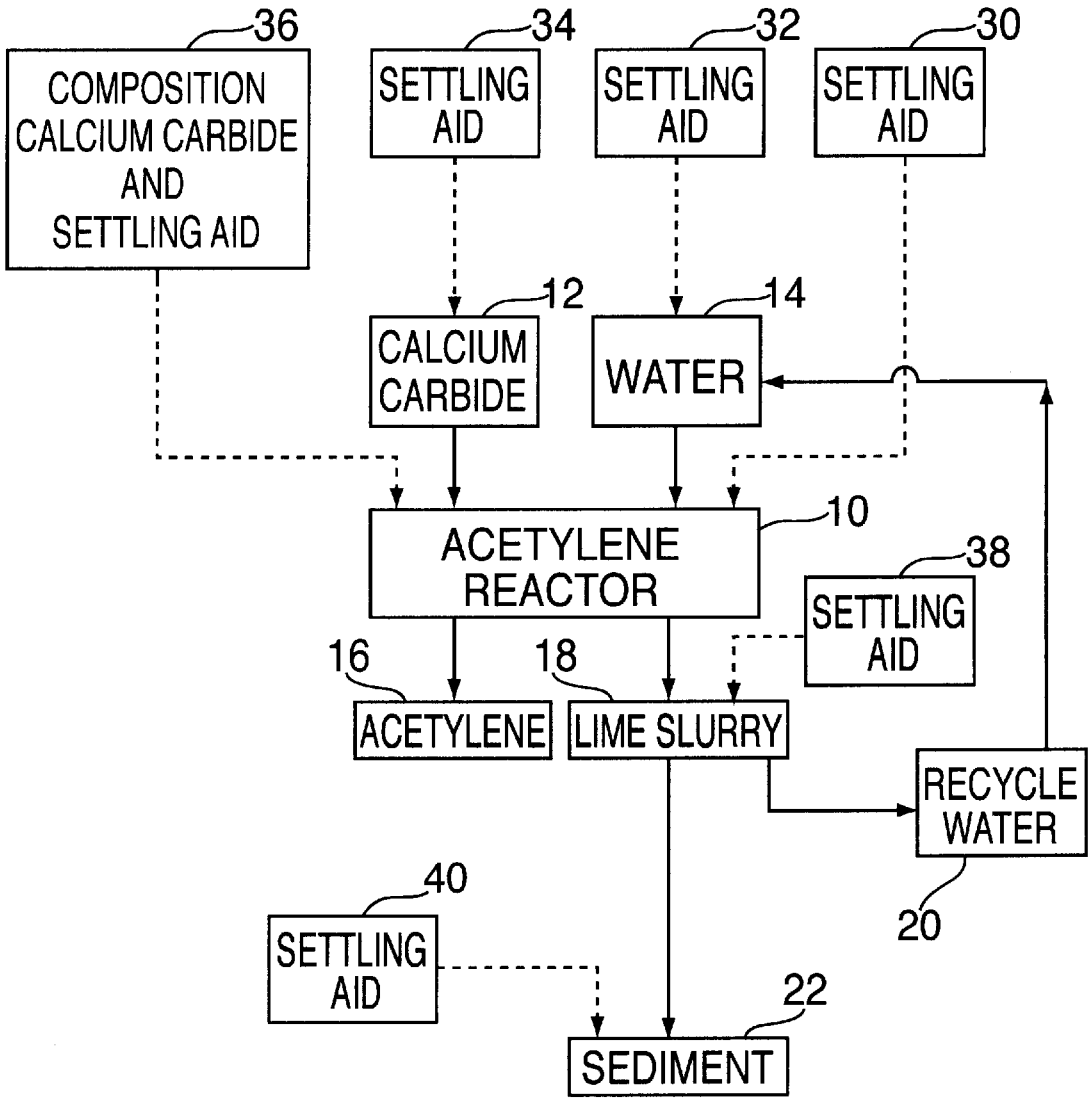
FIG. 1 illustrates the method of the present invention.

FIG. 1 illustrates the method of the present invention wherein acetylene reactor 10 receives reactants, calcium carbide 12 and water 14 to produce acetylene 16 and by-product lime slurry 18. By-product lime slurry 18 can have a settling aid present therein. Lime slurry 18 is normally pumped from acetylene reactor 10 to settling tanks. From the settling tanks, recycled water 20 is removed and recycled back to the original water 14. Sediment 22 forms in the settling tanks and is removed from the settling tanks, usually by reslurrying and pumping the reslurried sediment out of the tanks, and into a land fill.

FIG. 1 illustrates the use of the settling aid in accordance with the present invention. The points of addition of the settling aid are shown by employing dotted lines in FIG. 1.

Specifically, settling aid 30 can be added directly to acetylene reactor 10 along with the other reactants of calcium carbide 12 and water 14. The addition of settling aid 30 to reactor 10 is done in a conventional manner using conventional equipment, such as a spray slurry.

Alternatively, settling aid 32 is added to water 14 which is then, in turn, added to reactor 10 as a reactant. The water and settling aid are mixed in a conventional manner using conventional equipment prior to its addition to reactor 10.

As yet another alternative to the present invention, settling aid 34 is added by the acetylene manufacturer to the calcium carbide 12. The calcium carbide and settling aid are mixed in a conventional manner using conventional equipment. The mixture of calcium carbide and settling aid is then added to reactor 10 as a reactant.

A still further alternative to the present invention is for the acetylene manufacturer to employ composition 36 which comprises calcium carbide and a settling aid. Composition 36 is added to reactor 10 in a conventional manner using conventional equipment. Composition 36 is provided to the acetylene producer by the calcium carbide manufacturer. In this way, the acetylene manufacturers need not concern themselves with how much of the settling aid to add to reactor 10 directly or to reactants, calcium carbide 12 and water 14.

Alternatively, a combination of two or more of 30, 32, 34 and 36 can be employed. For example, the calcium carbide manufacturer could employ a portion of composition 36 in conjunction with calcium carbide 12. In this way, the acetylene manufacturer would be employing two different sources of calcium carbide, one without the settling aid and one with the settling aid. This combination of calcium carbide sources would allow the acetylene manufacturer to practice the present invention by having the settling aid present in the reactor during the reaction while allowing the acetylene manufacturer flexibility of obtaining calcium carbide from different sources.

Finally, as another alternative, the settling aid can be added to the by-product lime slurry or sediment. Settling aid 38 can be added to lime slurry 18 as it is pumped from the reactor 10 or when it is in the settling tanks. Adding settling aid 38 to the out flow of reactor 10 or to the settling tanks is not preferred since the lime slurry is formed in the reactor and may start to exhibit handling problems in reactor 10. This addition is done in a conventional manner using conventional equipment to insure that the settling aid is homogeneously mixed into the lime slurry.

Settling aid 40 can be added to sediment 22 as it sits in the settling tanks. Adding settling aid 40 to sediment 22 is not preferred because the increased settling rate is not obtained, even though improved sediment handling characteristics are obtained. Such an addition is done in a conventional manner using conventional equipment.

Thus, it is preferred in accordance with the present invention, that the settling aid be present in the reactor during the reaction. The mixing of the settling aid with the other reactants is done in a conventional manner using conventional equipment. The addition of the settling aid to either the reactants or the reactor is done in a conventional manner using conventional equipment. The addition of the composition of calcium carbide and settling aid to the reactor is also done in a conventional manner using conventional equipment. Finally, the addition of the settling aid to the lime slurry or the sediment is done in a conventional manner using conventional equipment.

The formulation of the composition of calcium carbide and settling aid by calcium carbide manufacturers is done in a conventional manner using conventional equipment so as to form a homogeneous mixture of the two. The two components, calcium carbide and the settling aid, are added in the appropriate amounts and mixed so as to form a homogeneous mixture. This mixture is formed after the calcium carbide has been made and crushed to an appropriate size for use in acetylene manufacture.

The amount of settling aid used in the present invention is suitably an effective amount, effective to improve the settling properties and/or handling properties of the by-product lime slurry and sediment. Preferably, the settling aid is present in an amount of less than or equal to about 25% by weight calcium carbide in the reactor. More preferably, the settling aid is present in an amount of about 0.01% to about 25% by weight based on the calcium carbide used in the reactor. More preferably, the amount of settling aid used in the present invention is less than or equal to about 1% by weight of the calcium carbide that is used in the reaction. Good results have been obtained when employing the settling aid in an amount of about 0.1% to about 1.0% by weight calcium carbide in the reactor.

Suitably, the composition of the present invention is a homogeneous mixture comprising a settling aid in an amount of less than or equal to about 20% by weight mixture and calcium carbide in an amount of greater than or equal to about 80% by weight mixture. Preferably, the composition comprises about 0.01% to about 20% by weight settling aid and about 99.99% to about 80% by weight calcium carbide. More preferably, the composition of the present invention is a mixture that comprises a settling aid in an amount of less than or equal to about 1% by weight mixture and calcium carbide in an amount of greater than or equal to about 99% by weight mixture. Good results have been obtained with the present invention with a composition comprising a mixture of about 0.1% to about 1.0% by weight settling aid and about 99.9% to about 99% by weight calcium carbide.

Phosphates which are suitable as settling aids in accordance with the present invention include phosphate salts and molecular dehydrated phosphates. Suitable phosphate salts include sodium, potassium and ammonium salts of phosphate. Specifically, suitable phosphate salts include:

monobasic sodium phosphate ($NaH_2PO_4$),
dibasic sodium phosphate ($Na_2HPO_4$),
tribasic sodium phosphate ($Na_3PO_4$),
monobasic ammonium phosphate ($NH_4H_2PO_4$),
dibasic ammonium phosphate ($(NH_4)_2HPO_4$),
monobasic potassium phosphate ($KH_2PO_4$),
dibasic potassium phosphate ($K_2HPO_4$), and
tribasic potassium phosphate ($K_3PO_4$)

Monobasic sodium phosphate is preferred.

Suitable molecular dehydrated phosphates include:

sodium tripolyphosphate ($Na_5P_3O_{10}$),
hexametaphosphate ($((CH_3)_2N)_3PO$), and
tetrapotassiumphosphate ($K_4P_2O_7$)

Suitable chelating agents which can be employed as a settling aid in accordance with the present invention include ethylenediaminetetraacetic acid ($(HOOCCH_2)_2NCH_2CH_2N(CH_2COOH)_2$) (EDTA) and salts of EDTA. Other suitable chelating agents include salts of nitrolotriacetic acid ($N(CH_2COOH)_3$) and sodium citrate ($C_6H_5O_7Na_3$).

Suitable alkali metal chlorides which can be used as settling aids in accordance with the present invention include lithium chloride (LiCl), sodium chloride (NaCl), potassium chloride (KCl). Sodium chloride is preferred because of expense.

Suitable carbonates which can be used as settling aids in accordance with the present invention include sodium carbonate ($Na_2CO_3$), calcium carbonate ($CaCO_3$) and potassium carbonate ($K_2CO_3$).

Suitable carboxylic acids which can be used in accordance with the present invention include citric acid ($C_6H_8O_7$), tartaric acid ($C_3H_4O_5$) and acetic acid ($C_2H_4O_2$).

Suitable sulfur compounds which can be used in accordance with the present invention include sodium bisulfite ($NaHSO_3$), sodium sulfite ($NA_2SO_3$) and sodium sulfate ($Na_2SO_4$). Sodium bisulfite is preferred.

Suitable clay and clay minerals which can be used in accordance with the present invention include kaolinite, montmorillonite, attapulgite, illite, bentonite, and halloysite. Bentonite is preferred.

Suitable sugars which can be used in accordance with the present invention include glucose, sucrose, and fructose.

Silica fumes can also be employed as a settling agent in accordance with the present invention. Silica fume is conventionally available as a by-product from manufacturers of ferrosilicon and silicon metal. Silica fume is also referred to as microsilica.

More specifically, silica fume is produced by capturing the finely divided particles from stack gases of electric arc furnaces. Silica fume is a pozzolan, i.e., it combines with lime and moisture at ordinary temperature to form compounds having cementitious properties. The main constituent is silicon dioxide($SiO_2$) and it is usually present in an amount of at least about 80%.

An amorphous silica fume that is eminently suitable for use in the present invention is obtained as a by-product in the production of silicon metal or ferrosilicon in electric reduction furnaces. In these processes, fairly large quantities of silica are formed as dust which is recovered in filters or other collection apparatus. Such silica fume can be obtained from Elkem Metals Company, Pittsburgh, Pa., US.

The amorphous silica used in the present invention is composed substantially of sub-micron, spherical particles. The spherical shape together with its fineness pozolanic activity makes it surprisingly useful in accordance with the present invention.

For example, the amorphous silica fume particles may consist of at least 60 to 90% by weight of $SiO_2$, will have a real density of 2.20–2.25 g/cm$^3$ and will have a specific surface area of 18–22 m$^2$/g, the particles being substantially spherical, and wherein at least 90% by weight of the primary particles have a particle size of less than 1 micron. Of course, variation of these values is readily possible. For example, the silica fume may have a lower $SiO_2$ content.

Lignin is a major non-carbonate constituent of wood and often a by-product from paper processing. Lignin sulfonate can also be used in the present invention.

One or more settling aids can be used in the present invention. When more than one settling aid is used, the amount of combined settling aids must be within the parameters of the present invention, e.g. within about 0.01% to about 25% by weight calcium carbide.

It is important for slurry to settle quickly but not become too dense to prevent reslurrying. A balance must be struck between the rate of settling and the ability for the sediment to be reslurried and subsequently pumped. Thus, the optimal amount of settling aid may vary from settling aid to settling aid within the parameters set forth in this application. The optimum amount of settling aid can be readily determined.

Conventionally, the slurry has a solids content of about 30% to about 40% by weight, the sediment has a solids content of about 70% to about 80% by weight, and the reslurried sediment has a solids content of about 30% to about 40% by weight.

These and other aspects of the present invention may be more fully understood by reference to one or more of the following examples.

EXAMPLE 1

This example illustrates the use of various settling aids in accordance with the present invention.

Into a 500 ml cylinder, 400 ml of water, 60 grams of calcium carbide and a certain amount of a settling aid were added. Acetylene gas was produced and, after production of the gas, a lime slurry with the settling aid remained in the cylinder.

The Table below lists the settle aids tested, the amount of settle aid employed based on the weight of calcium carbide, whether the settling aid was mixed into calcium carbide and the mixture of calcium carbide and settling aid (S) added to the cylinder or whether the settling aid was added to the water and the mixture of water and settling aid (W) added to the cylinder.

Also listed in the Table below is the rate of settling (ml/hour) and the density of the sediment over a period of days.

In order to determine settling rate and density of the sediment, a portion of the lime slurry was poured into a graduated cylinder.

Settling was determined immediately by measuring the speed at which the sediment dropped in the cyclinder over time. The rate was measured in milliliters per hour, the milliliters corresponding to the increments on the graduated cylinder. Thus, the settling rate is that of the lime slurry in the first hour after completion of the reaction between the water and the calcium carbide.

The density of the sediment was determined by thrusting a glass rod into the sediment and characterizing the pressure that was necessary to thrust the rod into the sediment. These densities were graded on a scale of 1 to 5 with 5 being the less dense, no resistance, and 1 being the most dense. These densities were measured over a six day period.

LIME SLURRY SETTLING TESTS

| Test | Settling Aid & Amount* | rate | Day 1 | Day 2 | Day 3 | Day 4 | Day 5 | Day 6 |
|---|---|---|---|---|---|---|---|---|
| 1 | 3.33% Sod.P (W) | 1.67 | 5 | 5 | 5 | 5 | 5 | 5 |
| 2 | 1% salt (S) | 1.95 | n/a | n/a | 5 | 5 | 5 | 5 |
| 3 | .5% salt (S) | 2.14 | n/a | n/a | 5 | 5 | 5 | 5 |
| 4 | 1% Sod.P (S) | 2.33 | n/a | 5 | 5 | 5 | 5 | 5 |
| 5 | .75% salt .25% clay (s) | 2.43 | n/a | n/a | n/a | 5 | 5 | 5 |
| 6 | .5% Sod P (S) | 2.62 | n/a | 5 | 5 | 5 | 5 | 5 |
| 7 | 3.333% salt (W) | 2.81 | 5 | 5 | 5 | 5 | 5 | 5 |
| 8 | 2% Clay (S) | 2.81 | n/a | 5 | 5 | 5 | 5 | 5 |
| 9 | 1.67% salt (s) | 2.81 | n/a | n/a | 5 | 5 | 5 | 5 |
| 10 | 4% Clay (S) | 3.19 | 4 | 4 | 3 | 3 | 2 | 2 |
| 11 | carbide | 3.29 | 4 | 4 | 3 | 2 | 2 | 2 |
| 12 | .75% Sod.P 25% clay (S) | 3.36 | n/a | n/a | n/a | 5 | 5 | 5 |
| 13 | 1% Clay (S) | 3.48 | n/a | 5 | 5 | 5 | 5 | 5 |
| 14 | 8% Clay (S) | 4.00 | 5 | 4 | 4 | 3 | 3 | 3 |

*percent by weight calcium carbide

| | | |
|---|---|---|
| W | = | added to water |
| S | = | added to calcium carbide |
| Sod. P | = | monobasic sodium phosphate |
| Salt | = | sodium chloride |
| Clay | = | bentonite |
| n/a | = | not available (not tested) |

The amount of settling aid added is given as a percent of calcium carbide. Thus, in Test 1, 3.33% Sod. P (W) means that 2 grams of sodium monobasic phosphate was added and mixed into the water before combining the water with the calcium carbide. In Test 2, 1% salt(S) means that 0.6 gram of sodium chloride was added to the calcium carbide and then the mixture of salt and calcium carbide combined with water to make acetyline gas.

It will be noted that Test 11 had no settling aid present. Tests 5 and 12 employed two settling aids together.

It should also be noted that, even though the sediment in the tests above had sat for six days, it was still fluid enough to be readily movable.

EXAMPLE 2

This example illustrates field tests which were performed on commercial scale acetylene reactors.

Monobasic sodium phosphate in an amount of 0–2% by weight calcium carbide was added to 600 pounds (270 kg) of calcium carbide and used in a reactor to form acetylene.

The resulting sediment was found to readily reslurry and to be pumpable.

EXAMPLE 3

This example illustrates that a top treatment of the sediment using the settling aid of the present invention also works.

An untreated lime slurry was allowed to settle in two separate beakers so as to form a sediment in both beakers. After settling, monobasic sodium phosphate was added to the top of the sediment in one beaker as a settling aid. The other beaker was not treated. Water is then added to both sediments to reslurry the sediments.

The sediment in the treated beaker is readily reslurried and pumpable. The untreated slurry is not readily reslurried and is more difficult to move than the top treated sediment.

EXAMPLE 4

This example illustrates the present invention with different calcium carbides.

Two calcium carbides are employed, one made with petroleum coke and another made with metallurgical coke. Into two different beakers each of the calcium carbides and water are added along with 1% by weight of monobasic sodium phosphate. Each beaker is placed under a hood to allow for generation of acetylene gas. After production of acetylene gas, the sediment with the settling aid is allowed to settle. The two sediments are found to have the same characteristics.

It will be understood that the claims are intended to cover all changes and modifications of the preferred embodiments of the invention herein chosen for the purpose of illustration which do not constitute a departure from the spirit and scope of the invention.

What is claimed is:

1. A method for treating a lime slurry by-product from acetylene production to make the lime slurry easier to handle comprising:

reacting water with calcium carbide in a reactor to form acetylene and a by-product lime slurry in the presence of a settling aid, said lime slurry having an increased rate of settling due to said settling aid; and recovering said lime slurry with said settling aid present therein.

2. The method of claim 1 wherein the settling aid is present in an amount of less than or equal to about 25% by weight calcium carbide.

3. The method of claim 1 wherein said settling aid is selected from the group consisting of phosphates, chelating agents, alkali metal chlorides, carbonates, carboxylic acids, sulfur compounds, clays, sugars, silica fume, and lignin.

4. The method of claim 1 further comprising the step of adding said settling aid to said reactor independent of said water and said calcium carbide.

5. The method of claim 1 further comprising the step of adding said settling aid to said water before adding said water to said reactor.

6. The method of claim 1 further comprising the step of adding said settling aid to said calcium carbide before adding said calcium carbide to said reactor.

7. In a method for making acetylene from calcium carbide and water where a by-product of lime slurry is formed and water is recycled from said lime slurry resulting in a sediment, the improvement comprising treating said sediment with a settling aid, and reslurrying said sediment with said settling aid present therein, said sediment having improved reslurrying properties due to said settling aid.

8. In a process for making acetylene from calcium carbide and water wherein a by-product is a lime slurry, the improvement comprising adding a settling aid to the by-product lime slurry as it exits the reactor such that said settling aid is present in said lime slurry in settling tanks, said lime slurry having an increased rate of settling due to said settling aid.

9. In a method for making acetylene from calcium carbide and water in a reactor to form acetylene and a by-product of lime slurry, the improvement comprising adding a settling aid to the reactor such that said settling aid is present in the reactor during production of acetylene and combines with the lime slurry by-product, said lime slurry having an increased rate of settling due to said settling aid.

10. The method of claim 9 wherein said settling aid is added to said calcium carbide prior to addition of the calcium carbide to the reactor.

11. The method of claim 10 wherein said settling aid is added to the water prior to addition to the reactor.

12. The method of claim 10 wherein said settling aid is added to said reactor independent of the addition of said calcium carbide and said water.

* * * * *